US009464432B2

(12) United States Patent
Lang et al.

(10) Patent No.: US 9,464,432 B2
(45) Date of Patent: Oct. 11, 2016

(54) METHOD AND SYSTEM FOR IMPROVED CURTAIN WALL SEALING

(71) Applicant: Oldcastle BuildingEnvelope, Inc., Plano, TX (US)

(72) Inventors: William J. Lang, Rockwall, TX (US); Greg A. Hall, Forney, TX (US); Phil Clark, Terrell, TX (US)

(73) Assignee: Oldcastle BuildingEnvelope, Inc., Plano, TX (US)

( * ) Notice: Subject to any disclaimer, the term of this patent is extended or adjusted under 35 U.S.C. 154(b) by 0 days.

(21) Appl. No.: 14/856,229

(22) Filed: Sep. 16, 2015

(65) Prior Publication Data

US 2016/0002919 A1 Jan. 7, 2016

Related U.S. Application Data

(63) Continuation of application No. 13/400,940, filed on Feb. 21, 2012, now Pat. No. 9,163,400.

(60) Provisional application No. 61/445,935, filed on Feb. 23, 2011.

(51) Int. Cl.
*E04B 2/88* (2006.01)
*E04B 2/96* (2006.01)

(52) U.S. Cl.
CPC ..... *E04B 2/965* (2013.01); *E04B 2/88* (2013.01); *E04B 2/96* (2013.01)

(58) Field of Classification Search
CPC ..... E04B 2/96; E04B 2/965; E04B 2/88
See application file for complete search history.

(56) References Cited

U.S. PATENT DOCUMENTS

| | | | |
|---|---|---|---|
| 334,160 | A | 1/1886 | Berger |
| 2,282,631 | A | 5/1942 | Winship |
| 2,703,002 | A | 3/1955 | Suskind |
| 2,777,405 | A | 1/1957 | Ager |
| 2,810,173 | A | 10/1957 | Bearden |
| 2,963,126 | A | 12/1960 | Cudini |
| 3,147,518 | A | 9/1964 | Horgan |
| D199,828 | S | 12/1964 | Regan |

(Continued)

FOREIGN PATENT DOCUMENTS

| | | |
|---|---|---|
| JP | 03-013644 | 1/1991 |
| JP | 06-065977 | 3/1994 |

(Continued)

*Primary Examiner* — Andrew J Triggs
(74) *Attorney, Agent, or Firm* — Winstead PC

(57) ABSTRACT

In one aspect, the present invention relates to a plug of the type utilized for sealing a junction between a horizontal member and a vertical mullion of a curtain wall. The plug may include a plug body. The plug body may include a front body portion, a rear body portion, a left body portion, a right body portion, a top surface disposed between the left body portion, the right body portion, the front body portion, and the rear body portion. A rabbet is disposed across the front body portion. A spacer flange extends from the front body portion. A plurality of chamfers are disposed between the top surface and the left body portion, the right body portion, and the rear body portions. The plug is sized to occupy a gap formed in the junction between the horizontal member and the vertical mullion of the curtain wall. The rabbet and the plurality of chamfers form a plurality of large crevices between the plug, the horizontal member, and the vertical mullion. The large crevices allow penetration of a sealant therein.

7 Claims, 5 Drawing Sheets

(56) References Cited

U.S. PATENT DOCUMENTS

| | | | | | |
|---|---|---|---|---|---|
| 3,266,210 | A | | 8/1966 | Grossman | |
| 3,293,813 | A | | 12/1966 | Emmons et al. | |
| 3,359,700 | A | | 12/1967 | Birum, Jr. | |
| 3,522,684 | A | | 8/1970 | Grossman | |
| 3,561,801 | A | | 2/1971 | Chiu | |
| D223,640 | S | | 5/1972 | Kemp | |
| D229,757 | S | | 1/1974 | Hansen | |
| 3,787,130 | A | | 1/1974 | Hemmings et al. | |
| 3,797,948 | A | | 3/1974 | Weininger | |
| 3,798,862 | A | * | 3/1974 | Stoakes | E04B 2/965 52/204.591 |
| 3,940,897 | A | * | 3/1976 | Stoakes | E04B 2/60 52/204.591 |
| D241,312 | S | | 9/1976 | McLintock et al. | |
| 4,006,573 | A | | 2/1977 | Biebuyck | |
| 4,050,201 | A | | 9/1977 | Hubbard et al. | |
| 4,055,923 | A | | 11/1977 | Biebuyck | |
| 4,075,800 | A | | 2/1978 | Molick | |
| 4,101,233 | A | | 7/1978 | McConnell | |
| D250,189 | S | | 11/1978 | Hansen | |
| 4,214,405 | A | | 7/1980 | Chupik | |
| 4,276,729 | A | | 7/1981 | Kage | |
| 4,307,551 | A | | 12/1981 | Crandell | |
| 4,307,976 | A | | 12/1981 | Butler | |
| 4,310,995 | A | | 1/1982 | Hanna | |
| 4,363,420 | A | | 12/1982 | Andrews | |
| 4,364,209 | A | | 12/1982 | Gebhard | |
| 4,370,827 | A | | 2/1983 | Furuminato | |
| 4,387,542 | A | | 6/1983 | Wehr | |
| 4,488,378 | A | | 12/1984 | Symon | |
| 4,519,173 | A | | 5/1985 | Roberts | |
| 4,545,161 | A | | 10/1985 | Baumann | |
| 4,573,287 | A | | 3/1986 | Hagemeyer | |
| 4,584,804 | A | | 4/1986 | Tajima | |
| 4,611,447 | A | | 9/1986 | Krechel | |
| 4,614,069 | A | | 9/1986 | Tanikawa | |
| 4,619,092 | A | | 10/1986 | Kaminaga | |
| 4,627,201 | A | | 12/1986 | Hamamoto | |
| 4,633,631 | A | | 1/1987 | Crandell | |
| 4,638,613 | A | | 1/1987 | Tonsmann | |
| 4,644,717 | A | | 2/1987 | Biebuyck | |
| 4,662,136 | A | | 5/1987 | Tanikawa | |
| 4,662,145 | A | | 5/1987 | Tanikawa | |
| 4,680,902 | A | | 7/1987 | Stefnik | |
| 4,685,263 | A | | 8/1987 | Ting | |
| D293,885 | S | | 1/1988 | Carlmark | |
| 4,720,876 | A | | 1/1988 | Tomei | |
| 4,724,637 | A | | 2/1988 | Evans | |
| 4,773,193 | A | | 9/1988 | Biebuyck | |
| 4,783,941 | A | | 11/1988 | Loper | |
| 4,799,344 | A | | 1/1989 | Francis | |
| 4,803,820 | A | | 2/1989 | Metrick | |
| 4,817,351 | A | | 4/1989 | Michlovic | |
| 4,841,700 | A | | 6/1989 | Matthews | |
| 4,843,791 | A | * | 7/1989 | Michlovic | E06B 3/68 52/204.593 |
| 4,854,095 | A | * | 8/1989 | Michlovic | E04B 2/965 52/204.591 |
| 4,866,896 | A | | 9/1989 | Shreiner | |
| 4,873,806 | A | | 10/1989 | Jeschke | |
| 4,899,508 | A | | 2/1990 | Biebuyck | |
| 4,910,931 | A | | 3/1990 | Pardue, Jr. | |
| D310,847 | S | | 9/1990 | Dietz | |
| 4,956,948 | A | | 9/1990 | Hart | |
| 4,956,954 | A | | 9/1990 | Horgan | |
| 4,979,344 | A | | 12/1990 | Kusunoki | |
| 4,984,400 | A | | 1/1991 | Bockmiller | |
| 4,996,809 | A | | 3/1991 | Beard | |
| 5,036,637 | A | | 8/1991 | Biebuyck | |
| 5,058,344 | A | | 10/1991 | Biebuyck | |
| 5,065,557 | A | | 11/1991 | Laplante | |
| 5,067,293 | A | * | 11/1991 | Reynolds | E04B 2/965 52/235 |
| 5,077,947 | A | | 1/1992 | Takeda | |
| 5,107,647 | A | | 4/1992 | Danielewicz | |
| 5,185,979 | A | | 2/1993 | Azzimonti | |
| 5,252,154 | A | | 10/1993 | Hoffman | |
| 5,253,459 | A | | 10/1993 | Parinas | |
| D347,857 | S | | 6/1994 | Coe | |
| 5,319,882 | A | | 6/1994 | Biebuyck | |
| 5,333,428 | A | | 8/1994 | Taylor et al. | |
| 5,354,410 | A | | 10/1994 | Cohen | |
| 5,369,924 | A | | 12/1994 | Neudorf | |
| D363,453 | S | | 10/1995 | Herdt | |
| 5,469,665 | A | | 11/1995 | Biebuyck | |
| 5,481,839 | A | | 1/1996 | Lang et al. | |
| 5,546,713 | A | | 8/1996 | Voegele | |
| 5,560,149 | A | | 10/1996 | Lafevre | |
| 5,590,492 | A | | 1/1997 | Cucchiara et al. | |
| 5,592,795 | A | | 1/1997 | Rinehart et al. | |
| 5,596,851 | A | | 1/1997 | Ting | |
| D378,219 | S | | 2/1997 | Marshlack | |
| 5,644,875 | A | | 7/1997 | Nielsen et al. | |
| 5,706,625 | A | | 1/1998 | Vallance et al. | |
| D393,813 | S | | 4/1998 | Herdt | |
| 5,746,032 | A | | 5/1998 | Koike | |
| 5,749,175 | A | | 5/1998 | Koike | |
| 5,771,652 | A | | 6/1998 | Nagata et al. | |
| 5,839,236 | A | | 11/1998 | Frey | |
| 5,875,602 | A | | 3/1999 | Lappin et al. | |
| 5,893,244 | A | | 4/1999 | Magoon | |
| 5,930,955 | A | | 8/1999 | Biebuyck | |
| 5,937,597 | A | | 8/1999 | Sono et al. | |
| 5,950,370 | A | | 9/1999 | Peck | |
| 6,158,182 | A | | 12/2000 | Biebuyck | |
| 6,226,940 | B1 | | 5/2001 | Biebuyck et al. | |
| 6,581,342 | B1 | | 6/2003 | Tavivian | |
| 6,715,248 | B2 | | 4/2004 | Biebuyck | |
| 6,745,527 | B1 | | 6/2004 | Sherman et al. | |
| 6,804,920 | B2 | | 10/2004 | Hogan | |
| 6,993,873 | B2 | | 2/2006 | Biebuyck et al. | |
| 7,080,488 | B2 | | 7/2006 | Hocker et al. | |
| 7,191,566 | B2 | | 3/2007 | Back et al. | |
| 7,389,617 | B2 | | 6/2008 | Grunewald | |
| 7,631,471 | B2 | * | 12/2009 | Grunewald | E06B 7/14 52/16 |
| 7,818,934 | B2 | * | 10/2010 | Hall | E04B 2/965 52/235 |
| 2002/0152693 | A1 | | 10/2002 | Krogstad | |
| 2004/0016329 | A1 | | 1/2004 | Holzschuh | |
| 2004/0031220 | A1 | | 2/2004 | Hocker et al. | |
| 2004/0163329 | A1 | | 8/2004 | Back et al. | |
| 2005/0000181 | A1 | * | 1/2005 | Grunewald | E04B 2/96 52/459 |
| 2005/0138875 | A1 | * | 6/2005 | Grunewald | E06B 7/14 52/302.1 |
| 2005/0138889 | A1 | | 6/2005 | Biebuyck | |
| 2006/0016137 | A1 | | 1/2006 | Ferro | |
| 2006/0080917 | A1 | * | 4/2006 | Hall | E04B 2/965 52/235 |
| 2006/0201084 | A1 | * | 9/2006 | Arias | E04B 2/965 52/235 |
| 2012/0210664 | A1 | * | 8/2012 | Lang | E04B 2/96 52/407.2 |

FOREIGN PATENT DOCUMENTS

| | | |
|---|---|---|
| JP | 06-158762 | 6/1994 |
| JP | 06-322866 | 11/1994 |

* cited by examiner

METHOD AND SYSTEM FOR IMPROVED CURTAIN WALL SEALING

CROSS-REFERENCE TO RELATED APPLICATIONS

This application is a continuation of U.S. patent application Ser. No. 13/400,940, filed Feb. 21, 2012. U.S. patent application Ser. No. 13/400,940 claims priority to U.S. Provisional Patent Application No. 61/445,935, filed Feb. 23, 2011. U.S. patent application Ser. No. 13/400,940 and U.S. Provisional Patent Application No. 61/445,935 are incorporated herein by reference in their entirety.

BACKGROUND

1. Field of the Invention

The present application relates to methods and systems for selectively sealing areas of curtain walls and more particularly, but not by way of limitation, to methods and systems for sealing junctions between horizontal and vertical support members of curtain walls during construction.

2. History of the Related Art

Building curtain-wall technology is well known and accepted in the industry. Curtain walls are typically constructed of, for example, extruded aluminum support members having generally U-shaped channels (although other shapes may be utilized) for supporting a plurality of panel members. The plurality of panel members serve as an exterior of a building and are usually panes of glass, and often double-pane glass sections, but other building materials such as, for example, aluminum, granite, slate, or concrete may be utilized. The plurality of panel members are often of identical size and shape. However, near doors, opening windows, and other access points into the building, panel members of different sizes and shapes may be utilized.

Curtain walls generally include a horizontal member intersecting with a vertical mullion at a junction. The junction typically requires cutting of at least a portion of the horizontal member around the vertical mullion. Sealing is often required between a cut portion of the horizontal member and the vertical mullion to prevent infiltration of, for example, water and other contaminants into the junctions. In many curtain-wall systems, a plug is inserted into a gap formed between a cut edge of the horizontal member and the vertical mullion. After insertion of the plug, the edges of the plug are sealed with a sealant such as, for example, silicone.

In many instances, edges of the horizontal member, the vertical mullion, and the plug are not precisely square due to, for example, human error or manufacturing limitations. These imperfections cause crevices to be present within the junctions. Furthermore, profile contours associated with the horizontal member, the vertical member, and the plug also create crevices. These crevices are often quite small and, in many cases, are nearly imperceptible to the human eye. Such crevices may, however, be sufficient to permit infiltration of water into the curtain-wall system. In addition, the crevices often make accurate placement of sealant difficult and time consuming due to an inability of a worker to see the crevices. Larger crevices are often more visible to a worker and, thus, more effectively sealed. Furthermore, larger crevices permit better infiltration of sealant thereby creating a better seal.

SUMMARY

In one aspect, the present invention relates to a plug of the type utilized for sealing a junction between a horizontal member and a vertical mullion of a curtain wall. The plug may include a plug body. The plug body may include a front body portion, a rear body portion, a left body portion, a right body portion, and a top surface disposed between the left body portion, the right body portion, the front body portion, and the rear body portion. A rabbet is disposed across the front body portion. A spacer flange extends from the front body portion. A plurality of chamfers are disposed between the top surface and the left body portion, the right body portion, and the rear body portion. The plug is sized to occupy a gap formed in the junction between the horizontal member and the vertical mullion of the curtain wall. The rabbet and the plurality of chamfers form a plurality of large crevices between the plug, the horizontal member, and the vertical mullion. The large crevices allow penetration of a sealant therein.

In another aspect, the present invention relates to a method of sealing a junction between a horizontal member and a vertical mullion of a curtain wall. The method may include forming a gap between the horizontal member and the vertical mullion and inserting a plug into the gap. The method may also include creating, via the plug, a plurality of large crevices between the plug, the horizontal member, and the vertical mullion and placing a sealant in the large crevices.

BRIEF DESCRIPTION OF THE DRAWINGS

For a more complete understanding of the present invention, and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
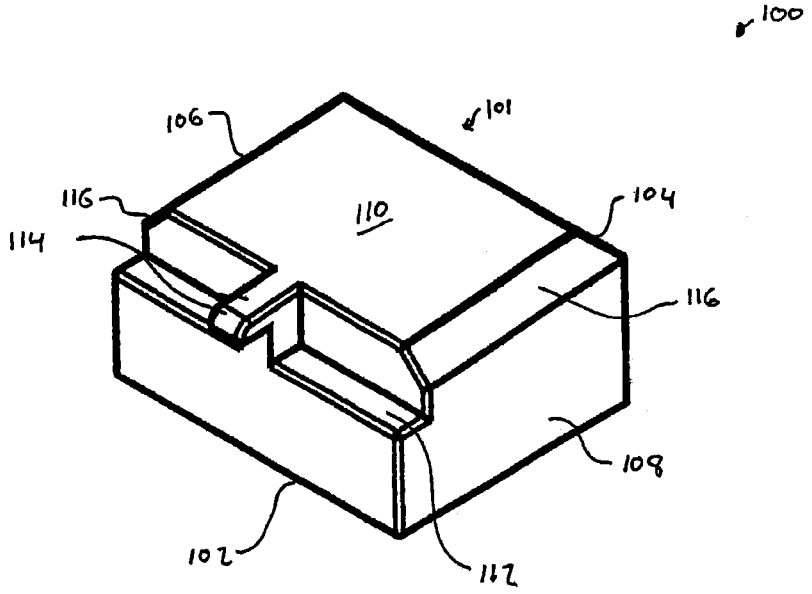
FIG. 1 is a perspective view of a plug according to an exemplary embodiment.

FIG. 1 is a perspective view of a plug according to an exemplary embodiment. A plug 100 includes a plug body 101. The plug body 101 includes a front body portion 102 and a rear body portion 104 disposed in a generally parallel relationship relative to each other. Similarly, the plug body 101 includes a left body portion 106 and a right body portion 108 disposed in a generally parallel relationship relative to each other and a generally perpendicular relationship relative to the front body portion 102 and the rear body portion 104. However, in various alternative embodiments, the front body portion 102, the rear body portion 104, the left body portion 106, and the right body portion 108 may be arranged in any configuration with respect to each other. A top surface 110 is disposed between the front body portion 102, the rear body portion 104, the left body portion 106, and the right body portion 108. In a typical embodiment, the front body portion 102, the rear body portion 104, the left body portion 106, the right body portion 108, and the top surface 110 define a hollow space within the plug body 101. In alternate embodiments, the plug 100 is solid.

Still referring to FIG. 1, in a typical embodiment, a rabbet 112 is formed along the front body portion 102. As used herein, the term "rabbet" refers to a recess or groove cut into an edge of a piece of machinable material. A spacer flange 114 extends in a generally orthogonal orientation from the front body portion 102. Chamfers 116 are disposed between the top surface 110 and the rear body portion 104, the left body portion 106, and the right body portion 108. As used herein, the term "chamfer" refers to a shallow cut, edge, or groove made in a corner of a machinable material. In a typical embodiment, the plug is constructed from a light-weight machinable material such as, for example, Teflon® or Delrin®, both manufactured and sold by E.I. du Pont de Nemours and Company of Wilmington, Del. In various other embodiments, the plug 100 may be constructed from any other machinable polymeric or metallic materials.

Figure 2:
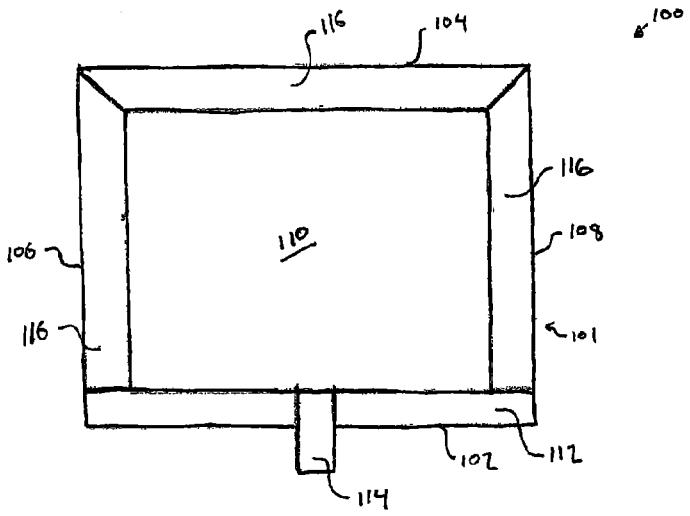
FIG. 2 is a top view of a plug according to an exemplary embodiment.

FIG. 2 is a top view of the plug 100 according to an exemplary embodiment. The spacer flange 114 is located approximately centrally between the left body portion 106 and the right body portion 108. In various alternative embodiments, the spacer flange 114 may be positioned elsewhere on the front body portion 102; however, as will be discussed further hereinbelow, the spacer flange 114 is located so as not to interfere with placement of sealant. FIG. 2 illustrates the plug 100 as including a single spacer flange 114; however, in various alternative embodiments, any number of spacer flanges 114 may be utilized depending on design requirements. The rabbet 112 extends substantially across the front body portion 102. As illustrated in FIGS. 1-2, in various embodiments, the rabbet 112 is interrupted by the spacer flange 114; however, in various alternative embodiments, the rabbet 112 may extend entirely across the front body portion 102 without interruption. Such an arrangement provides an uninterrupted The chamfers 116 extend substantially across the left body portion 106, the right body portion 108, and the rear body portion 104.

Figure 3:
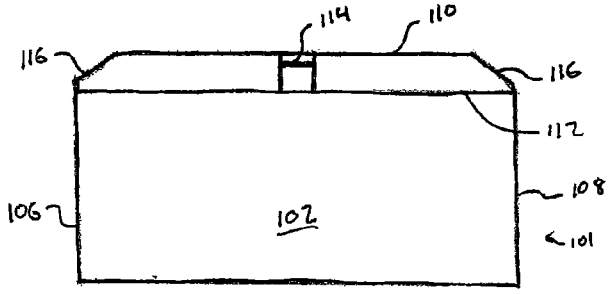
FIG. 3 is a front view of a plug according to an exemplary embodiment.

FIG. 3 is a front view of the plug 100 according to an exemplary embodiment. In a typical embodiment, the chamfers 116 are disposed at an angle of approximately 45 degrees relative to the left body portion 106, the right body portion 108, and the rear body portion 104 (shown in FIG. 2); however, in various alternative embodiments, the chamfers 116 may be formed at any appropriate angle. In a typical embodiment a depth of the rabbet 112 is approximately equal to a depth of the chamfers 116. However, in various alternative embodiments, the rabbet 112 may be formed shallower or deeper than the chamfers 116.

Figure 4:
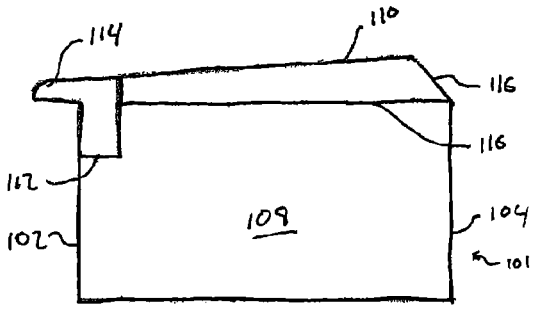
FIG. 4 is a side view of a plug according to an exemplary embodiment.

FIG. 4 is a side view of a plug according to an exemplary embodiment. The top surface 110 is sloped toward the front body portion 102 thereby directing moisture away from a vertical mullion 504 (shown in FIG. 5) and onto the horizontal member 502 (shown in FIG. 5). In various alternative embodiments, the top surface 110 may be flat or any other appropriate shape. As shown in FIGS. 2-4, the front body portion 102, the rear body portion 104, the left body portion 106 (shown in FIG. 1), and the right body portion 108 intersect each other at approximately right angles. However, in alternative embodiments, the front body portion 102, the rear body portion 104, the left body portion 106, and the right body portion 108 may intersect each other at any angle.

Figure 5:
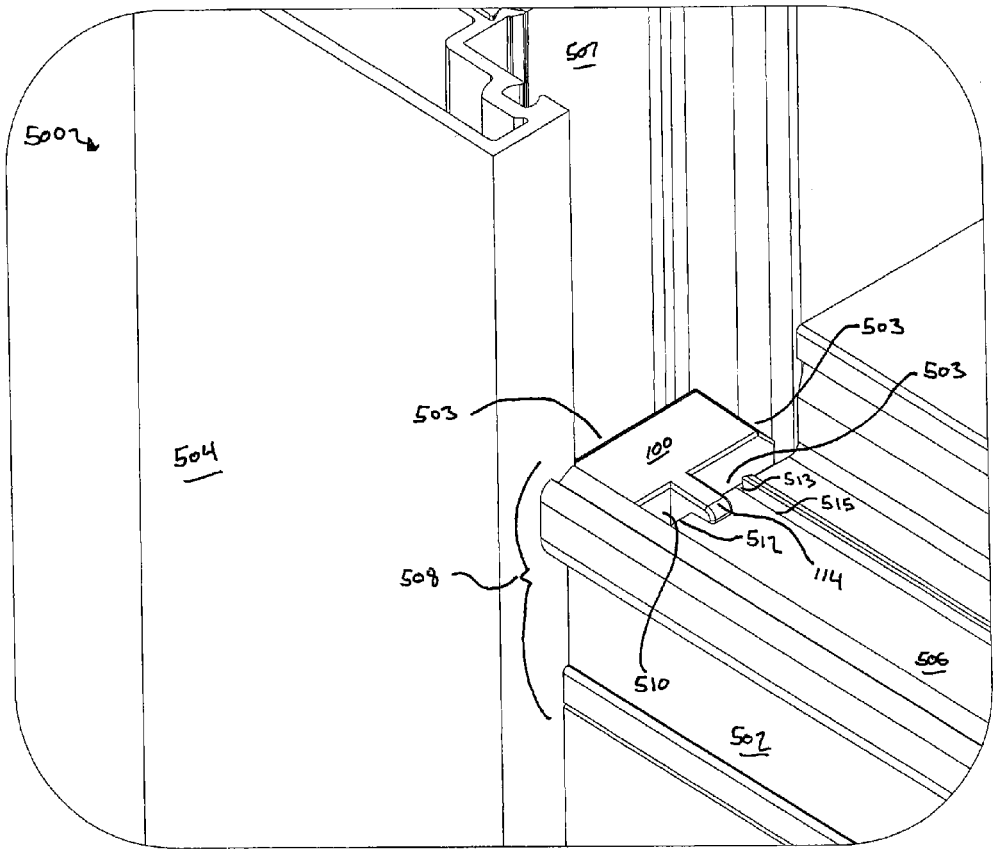
FIG. 5 is a perspective view of a curtain-wall junction according to an exemplary embodiment.

FIG. 5 is a perspective view of a curtain-wall junction according to an exemplary embodiment. A curtain-wall system 500 includes a horizontal member 502 and a vertical mullion 504. A horizontal thermal barrier 506 and a vertical thermal barrier 507 are disposed within the horizontal member 502 and the vertical mullion 504, respectively. In various other embodiments, however, the horizontal thermal barrier 506 and the vertical thermal barrier 507 may be omitted. In such embodiments, the horizontal member 502 and the vertical mullion 504 are unitary extrusions of, for example, aluminum. The horizontal member 502 and the vertical mullion 504 intersect at a junction 508. Within the junction 508, the horizontal member 502 and the horizontal thermal barrier 506 are cut to accommodate placement of the vertical mullion 504. A gap 510 is created between a cut edge 512 of the horizontal member 502 and the vertical thermal barrier 507. Further, in embodiments including the horizontal thermal barrier 506, small crevices 513 are present near an interface 515 of the horizontal thermal barrier 506 and the horizontal member 502.

Still referring to FIG. 5, in various alternative embodiments, the vertical mullion 504 and the vertical thermal barrier 507 are cut to accommodate placement of the horizontal member 502. For brevity and clarity of discussion, the present invention will be described herein as having the horizontal member 502 cut to accommodate placement of the vertical mullion 504.

Still referring to FIG. 5, in a typical embodiment, the plug 100 is inserted into the gap 510 such that the spacer flange 114 engages the cut edge 512 of the horizontal member 502. In embodiments including the horizontal thermal barrier 506 and the vertical thermal barrier 507, the spacer flange 114 engages the horizontal thermal barrier 506. Engagement of the spacer flange 114 with the cut edge 512 of the horizontal member 502 provides an indication of accurate placement of the plug 100 within the gap 510. In a typical embodiment, the spacer flange 114 ensures that the plug 100 is securely abutted against the both the horizontal member 502 and the vertical mullion 504. The spacer flange 114 further ensures that the plug 100 is not pulled through the gap 510 through operation of gravity. However, in a typical embodiment, the spacer flange does not interfere, or otherwise overlap, the small crevices 513 present near the interface 515. Such an arrangement prevents sealing of the small crevices 513. In a typical embodiment, the gap 510 is sized such that the plug 100 fits snugly therein. The plug 100, as shown in FIGS. 1-5 is generally rectangular-shaped when viewed from the top. However, one skilled in the art will recognize that, in alternative embodiments, the plug 100 may be any appropriate shape as required. The top surface 110 of the plug 100, in various embodiments, is shaped to match an interior contour of at least one of the horizontal member 502 or the vertical mullion 504.

Still referring to FIG. 5, during operation, the rabbet 112 and the chamfers 116 (shown in FIGS. 1-4) create large crevices 503 between the plug 100, the horizontal member 502, and the vertical mullion 504. The large crevices 503 provide a visual indicator to a worker of areas requiring sealant. In particular, the rabbet 112 allows ample room for sealant to completely cover the cut edge 512 of the horizontal member 502 thereby sealing the small crevices 513 present near the interface 515. Many sealants are viscous liquids or amorphous solids. The sealants, thus, are often not able to penetrate into small crevices due to high sealant viscosity. The large crevices 503 provide ample room to allow penetration of sealant. The large crevices 503 allow sealant to adhere to the cut end 512 of the horizontal member 502

Figure 6:
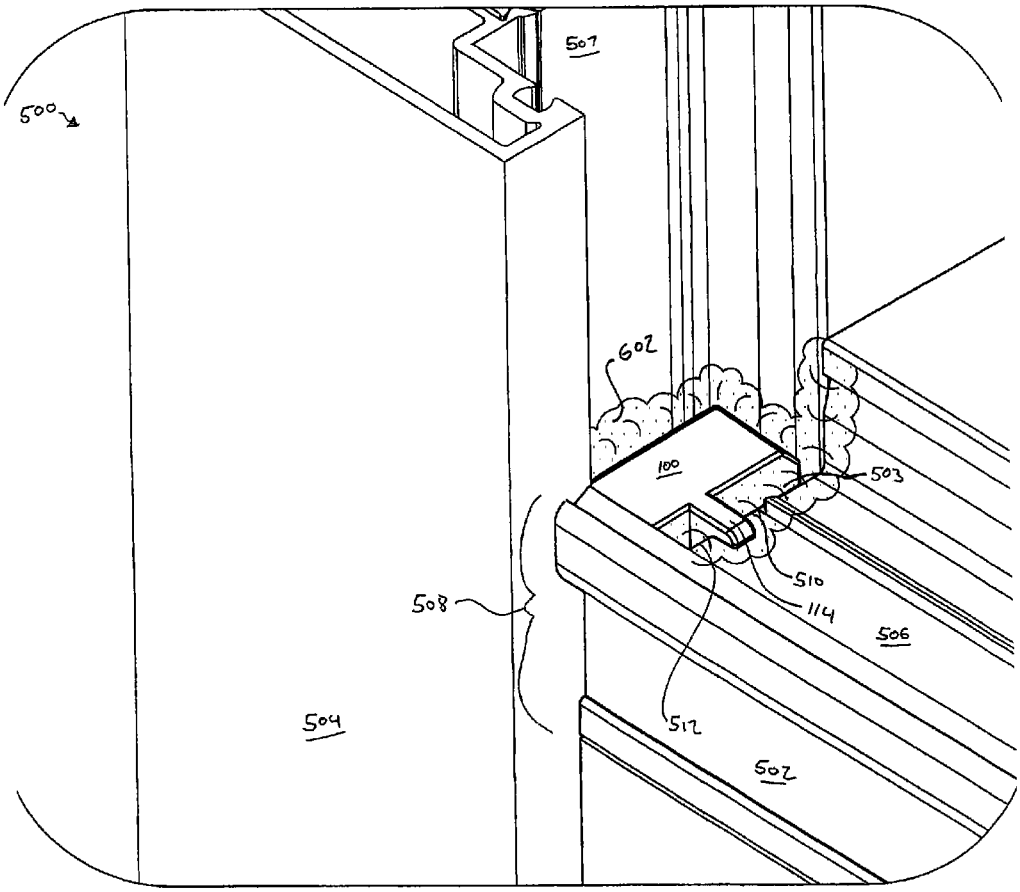
FIG. 6 is a perspective view of a curtain-wall junction according to an exemplary embodiment.

FIG. 6 is a perspective view of a curtain-wall junction according to an exemplary embodiment. Referring to FIGS. 5 and 6, after placement of the plug 100 within the gap 510, a sealant 602 such as, for example, silicone or any other industry-applicable sealant, is placed within the large crevices 503. The sealant 602 infiltrates the large crevices 503 around the plug 100 thereby sealing the junction 508 between the vertical mullion 504 and the horizontal member 502. In particular, the rabbet 112 (shown in FIG. 1) allows the sealant 602 to completely envelop the cut edge 512 of the horizontal member 502 thereby sealing the small crevices 513 present near the interface 515 of the horizontal thermal barrier 506 and the horizontal member 502. Combined use of the plug 100 and the sealant 602 effectively seals the gap 510 between the cut edge 512 of the horizontal member 502 and the vertical mullion 504.

Figure 7:
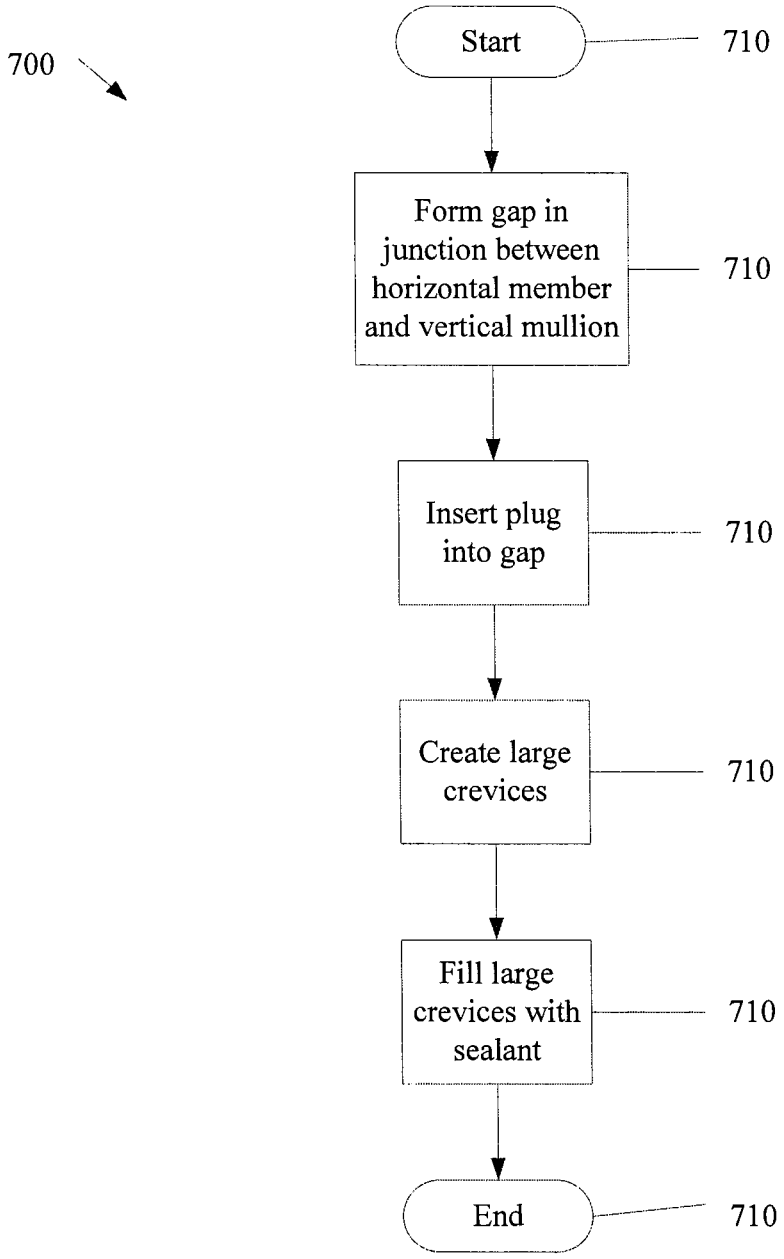
FIG. 7 is a flow diagram of a process for sealing a curtain-wall junction according to an exemplary embodiment.

FIG. 7 is a flow diagram of a process for sealing a curtain wall junction according to an exemplary embodiment. A process 700 starts at step 710. At step 720, a junction is formed in a curtain-wall system 500 between a horizontal member 502 and a vertical mullion 504 thereby creating a gap 510. At step 730, a plug 100 is inserted into the gap such that a spacer flange 114 engages the cut edge 512 of the horizontal member 502. At step 740, large crevices 503 are created as a result of the plug 100 having chamfers 116 and a rabbet 112. At step 750, the large crevices are filled with a sealant 602 such as, for example, silicone. The process 700 ends at step 760. In various embodiments, the horizontal member 502 and the vertical mullion 504 may include the horizontal thermal barrier 506 and the vertical thermal barrier 507 as discussed above with respect to FIGS. 5 and 6. As discussed above, the process 700 allows accurate placement of a sealant. In addition, the process 700 provides crevices of sufficient size to allow the sealant to penetrate and seal the crevice.

Referring now to FIGS. 1-7, the rabbet 112 and the chamfers 116 (shown in FIGS. 1-4) create large crevices 503 between the plug 100, the horizontal member 502, and the vertical mullion 504. The large crevices 503 provide a visual indicator to a worker of areas requiring sealant. Many sealants are viscous liquids or amorphous solids. The sealants, thus, are often not able to penetrate into small crevices due to high sealant viscosity. The large crevices 503 provide ample room to allow penetration of sealant.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A method of sealing a junction between a horizontal member and a vertical mullion of a curtain wall, the method comprising:

joining the horizontal member to the vertical mullion such that a gap is formed between the horizontal member and the vertical mullion;

aligning a plug with the gap, the plug comprising a body having a front body portion and a spacer flange disposed above and extending from the front body portion, the spacer flange having a long axis, said long axis extends in a direction that is generally perpendicular to the front body portion;

placing the plug into the gap such that a plurality of large crevices are formed between the plug, the horizontal member, and the vertical mullion; and placing a sealant in the large crevices.

2. The method of claim 1, wherein the gap is formed in the horizontal member.

3. The method of claim 1, wherein the gap is formed in the vertical mullion.

4. The method of claim 1, further comprising engaging the spacer flange with a cut end of at least one of the horizontal member and the vertical mullion.

5. The method of claim 4, further comprising aligning the plug in the gap via the spacer flange.

6. The method of claim 1, wherein the plug comprises a top surface that is contoured to match a surface contour of at least one of the horizontal member and the vertical mullion.

7. The method of claim 6, wherein the top surface is sloped towards the front body portion.

* * * * *